US005803346A

United States Patent [19]

Baker et al.

[11] Patent Number: 5,803,346

[45] Date of Patent: Sep. 8, 1998

[54] PAPERBOARD CONTAINER FOR LIQUIDS INCLUDING AN IMPROVED STRUCTURE TO PREVENT FITMENT ROTATION

[75] Inventors: Harold L. Baker, Longview; Christopher T. Benner, Vancouver; Terry Parks, Longview, all of Wash.

[73] Assignee: Longview Fibre Company, Longview, Wash.

[21] Appl. No.: 647,641

[22] Filed: May 15, 1996

[51] Int. Cl.[6] ..... B65D 5/32; B65D 5/56

[52] U.S. Cl. ..... 229/117.3; 229/117.35; 229/122.33; 229/122.21

[58] Field of Search ..... 229/23 R, 198.2, 229/939; 220/403, 410, 441, 443, 461, 462, 465; 222/105, 107

[56] References Cited

U.S. PATENT DOCUMENTS

| | | | |
|---|---|---|---|
| Re. 33,128 | 12/1989 | Nordstrom | 220/465 |
| 1,203,616 | 11/1916 | Hawkins | 229/198.2 |
| 1,698,532 | 1/1929 | Brooks | 229/198.2 |
| 3,114,494 | 12/1963 | Wasyluka | 229/198.2 |
| 3,937,392 | 2/1976 | Swisher . | |
| 3,972,454 | 8/1976 | Croley | 222/541 |
| 4,359,182 | 11/1982 | Perkins, Jr. . | |
| 4,421,253 | 12/1983 | Croley | 222/105 |
| 4,516,692 | 5/1985 | Croley | 229/105 |
| 4,549,673 | 10/1985 | Kupersmit | 220/465 |
| 4,585,143 | 4/1986 | Fremow et al. | 222/105 |
| 4,742,951 | 5/1988 | Kelly et al. | 229/23 R |
| 4,771,917 | 9/1988 | Heaps, Jr. et al. | 222/92 |
| 4,850,506 | 7/1989 | Heaps, Jr. et al. | 220/403 |
| 5,348,186 | 9/1994 | Baker | 220/465 |
| 5,353,982 | 10/1994 | Perkins et al. | 229/23 R |

*Primary Examiner*—Gary E. Elkins
*Attorney, Agent, or Firm*—Chernoff, Vilhauer, McClung & Stenzel, LLP

[57] ABSTRACT

An upright tubular shell has a top end, a bottom end, and a plurality of side-by-side sidewalls. The shell is constructed of a plurality of layers of paperboard material. A first one of the sidewalls defines a first portion adjacent a first upright edge of the first sidewall and has a thickness less than the thickness of the adjacent portion of the first sidewall. The first portion also comprises less than all of the plurality of layers of the paperboard material. The first portion overlaps and is attached to a second one of the sidewalls. A flexible impervious liner with an attached fitment is located within the shell. An outer opening is defined in one of the sidewalls proximate the bottom end for receiving a portion of the fitment. A bottom cap defines a first opening, a second opening, and a third opening. The first opening overlays the second opening. The outer opening is interdisposed between and aligned with the third and first openings.

38 Claims, 9 Drawing Sheets

PAPERBOARD CONTAINER FOR LIQUIDS INCLUDING AN IMPROVED STRUCTURE TO PREVENT FITMENT ROTATION

BACKGROUND OF THE INVENTION

The present invention relates to an improved paperboard container for fluids.

Paperboard containers having flexible liquid impervious liners are becoming more widely used as a substitute for steel drums. Not only are paperboard containers easily disposed of in an environmentally safe manner when their use is completed, they can be shipped unassembled at a much lower cost than steel drums. Examples of such containers are disclosed in Nordstrom, U.S. Pat. No. Re. 33,128; Heaps, Jr., et al., U.S. Pat. No. No. 4,850,506; Heaps, Jr., et al., U.S. Pat. No. 4,771,917; and Croley, U.S. Pat. No. 4,421,253.

Nordstrom, U.S. Pat. No. Re. 33,128 discloses a container constructed of inner and outer paperboard tubes open at both ends, with one inserted within the other. A bottom inner closure cap closes the open bottom end of the inner tube and has a plurality of peripheral flaps that are inserted between the inner and outer tubes. One of the flaps is hinged to a tab portion of the inner cap. The tab portion extends partially into the inner cap and terminates at a transverse score line to allow the tab to be hinged outward from the cap for inserting a fitment. The fitment, which is attached to a liner, is extended outward through aligned openings in the flap, inner tube, and outer tube. An outer bottom cap covers both the inner cap and outer tube. Nordstrom's structure involves an inner cap, an outer cap, an inner tube, and an outer tube, all of which must be assembled and each of which requires paperboard material to construct at considerable expense. Also, any significant transverse movement of the fitment relative to the sidewall which defines the opening, either while the container is being moved or while fluids are emptied through the fitment, tends to crease or break the container, decreasing its strength and ability to maintain its shape when filled.

What is desired, therefore, is a paperboard container with increased structural integrity to resist deformation from both movement of the container or emptying of fluids. Further, the container should be quick to assemble and minimize the amount of paperboard material required.

SUMMARY OF THE INVENTION

The present invention overcomes the aforementioned drawbacks of the prior art by providing, in a first aspect, an upright tubular shell having a top end, a bottom end, and a plurality of side-by-side sidewalls. A flexible impervious liner with an attached fitment is located within the shell. An outer opening is defined in one of the sidewalls proximate the bottom end for receiving a portion of the fitment. A bottom cap defines both a first opening and a second opening, with the outer opening interdisposed between and aligned with the first and second openings. Including both the first and second openings in the bottom cap allows a single paperboard piece to retain the fitment and close the bottom of the container.

In the preferred embodiment, the fitment includes a rectangular locking portion that engages the rectangular shaped inner portion of the fitment to prevent rotational movement of the fitment.

In another aspect of the present invention, the outer opening is offset toward a respective one of a pair of sides defined by the sidewall defining the outer opening. Offsetting the outer opening toward one side decreases the susceptibility of the sidewall to creasing or breaking.

In a further aspect of the present invention, the shell is constructed of paperboard material that includes a plurality of layers. A first one of the sidewalls defines a first portion adjacent a first upright edge of the first sidewall having a thickness less than the thickness of the adjacent portion of the first sidewall. The first portion also comprises less than all of the plurality of layers of the paperboard material. The first portion overlaps and is attached to a second one of the sidewalls. The overall thickness of the joint is reduced by using overlapping portions with different thicknesses.

In still a further aspect of the present invention, the bottom cap defines both a first opening and a second opening. The first opening overlays the second opening and they are both aligned with the outer opening. With a pair of openings overlaying one another the fitment retained therein has greater structural support without increasing the thickness of the bottom cap. The bottom cap can be a cassette type, if desired.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
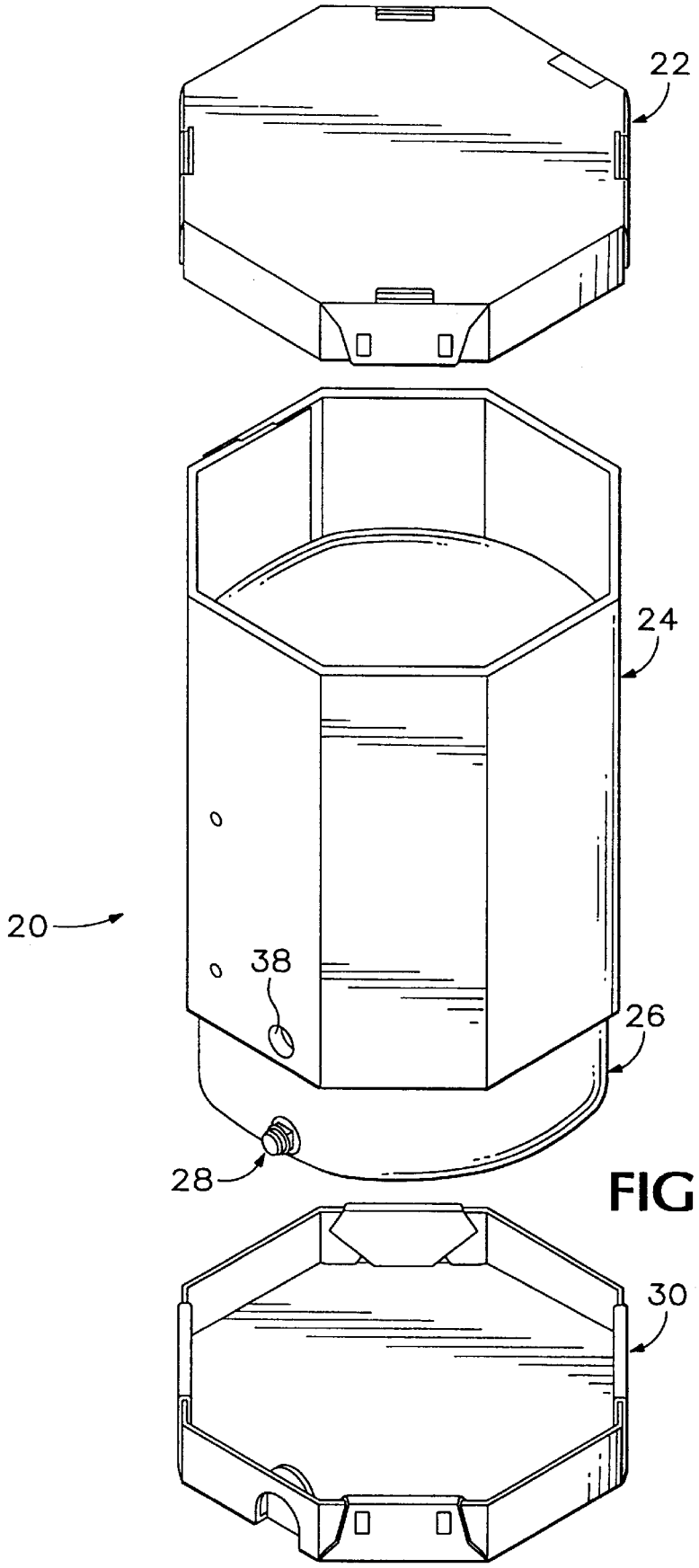
FIG. 1 is an exploded perspective view of the container embodying the present invention, including a top cap, a shell with an overlapping joint, a liner with an attached fitment, and a bottom cap.

Referring to FIG. 1, the container 20 is constructed of a top cap 22, an upright tubular shell 24, a liner 26 with an attached fitment 28, and a bottom cap 30. Preferably, the top cap 22, bottom cap 30, and shell 24 are constructed from a fully biodegradable material, such as paperboard, which permits them to be shipped flat and recycled after the container 20 is used. Since the shell 24 is the primary support element for the flexible impervious liner 26 placed therein, it should be constructed from corrugated paperboard to provide maximum stiffness and structural integrity.

Figure 2:
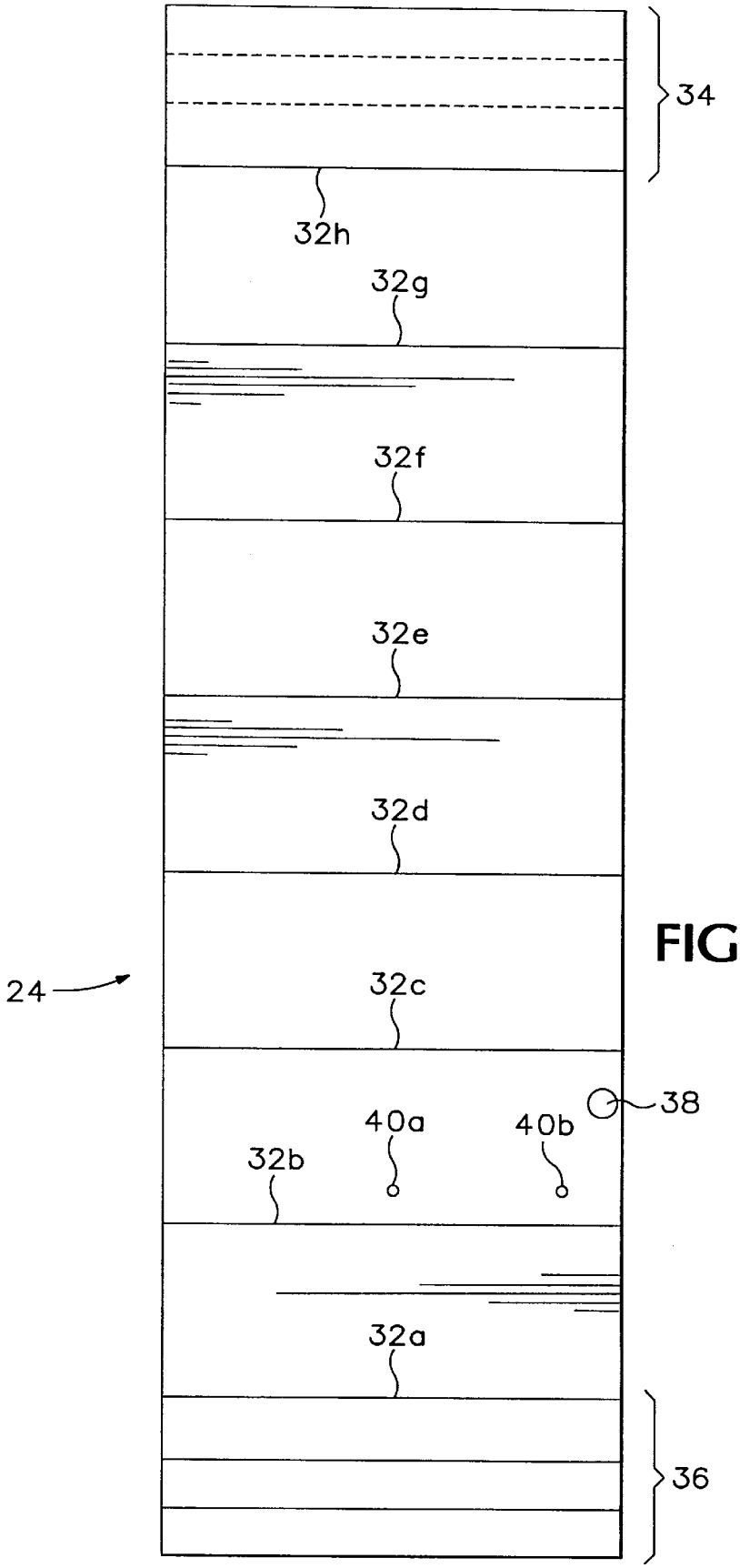
FIG. 2 is a plan view of the shell blank defining an outer opening and a pair of sight holes, as shown in FIG. 1.

Referring to FIG. 2, the shell 24 is made from a blank having fold lines 32*a*–32*h*. The right end portion 34 is adhered to the left end portion 36 in an overlapping manner, as described later. The shell 24 also defines an outer opening 38 suitable to receive the fitment 28. A pair of sight holes 40*a* and 40*b* allow the fluid level in the liner 26 to be monitored without opening the container.

Figure 3:
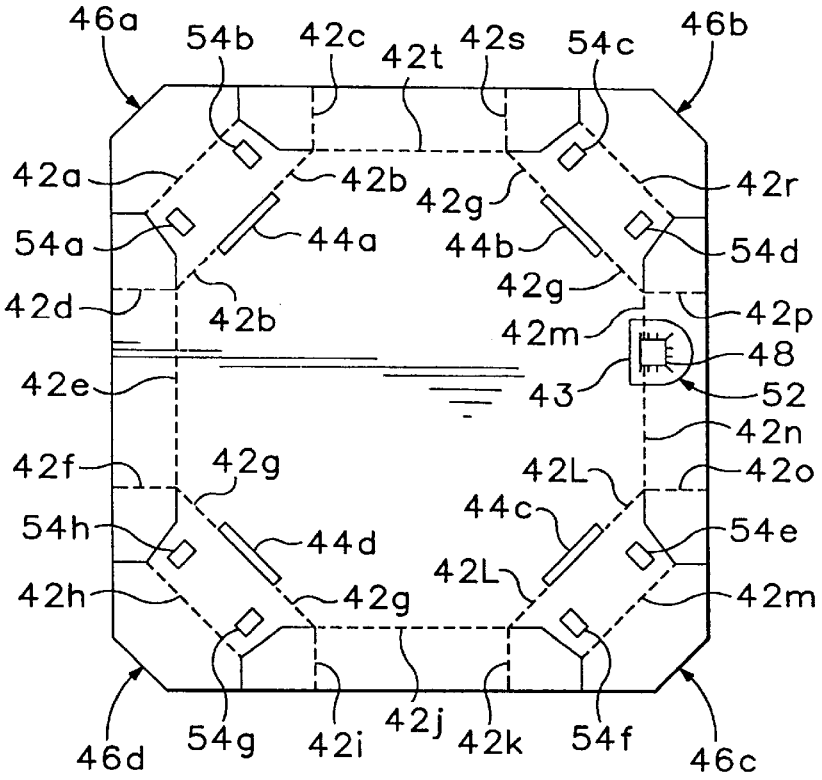
FIG. 3 is a plan view of the top and bottom cap blank including an integral locking member, as shown in FIG. 1.

Referring to FIG. 3, the bottom cap 30 and top cap 22 are constructed from a blank having fold lines 42*a*–42*t* and four rectangular openings 44*a*–44*d* in which respective corners 46*a*–46*d* are inserted into during assembly. First opening 50 (see FIG. 8*b*) and a second opening 48 are formed from a retaining assembly 52, as described later. The blank also includes guide openings 54*a*–54*h* that receive banding to maintain the banding in the proper location.

The liner 26 is constructed from material selected to be compatible with the contents to be carried in the container 20. In addition to the fitment 28 at its lower end, the liner 26 also may have a fitment 84 at its upper end for filling the container 20. The fitment 28 includes a locking portion 76 adjacent to the liner 26 having a rectangular cross-section. Located outwardly of the locking portion 76 is a ring 78 and a protruding portion 80 that is circular in cross-section. A circular cross-sectional passageway having a central axis extends through the fitment. The outer extremity of the passageway is threaded and a cap 82 having mating threads is screwed into the passageway to close it. Fitments of this type are commercially available and are referred to in the trade as Waddington and Duvall, or Hedwin type fitments. A dispensing control valve (not shown) subsequently may be attached, prior to the controlled dispensing of fluid from the container 20. The valve may be provided with a probe which, in the process of threaded attachment to the fitment 28, cuts a portion of the liner 26 which closes the inner end of the fitment. The preparation of the liner in this manner enables the liquid contained within the liner to exit through the fitment and control valve.

The outer opening 38 is offset toward one of the adjacent sides of the sidewall defining the outer opening 38. Offsetting the outer opening 38 toward one side decreases the susceptibility of the sidewall to creasing or breaking.

Figure 14:
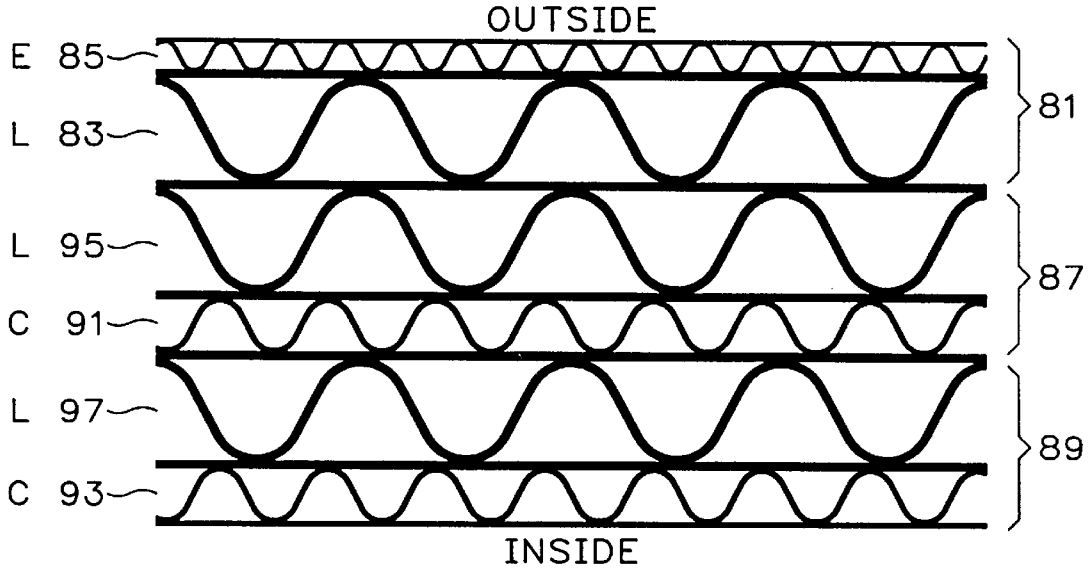
FIG. 14 is a breakaway sectional view of the shell shown in FIG. 1.
Figure 19:
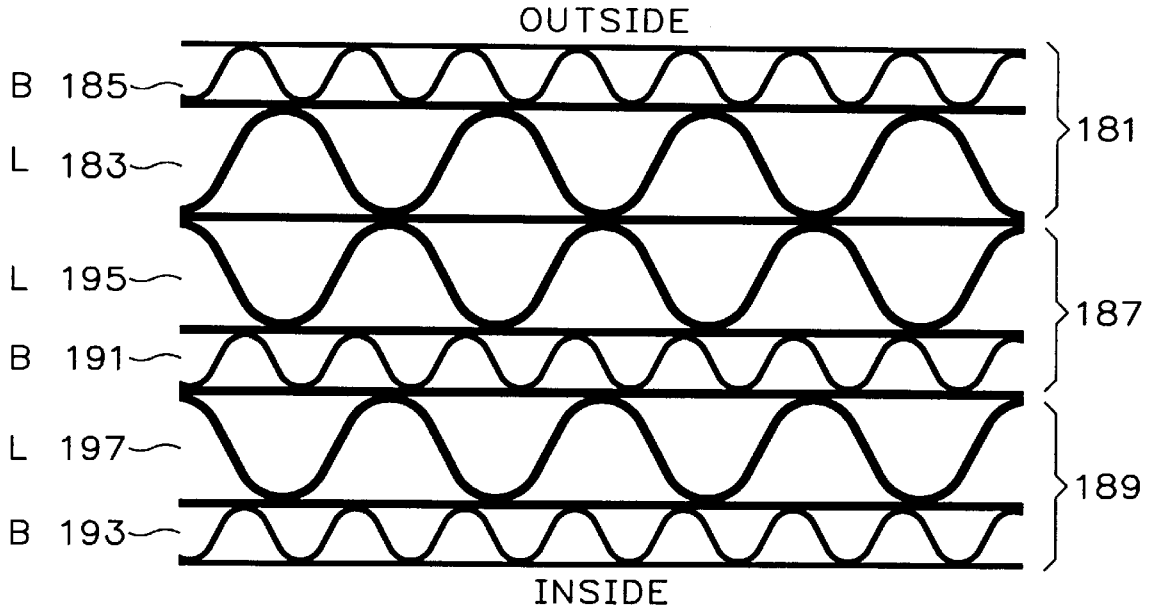
FIG. 19 is a breakaway sectional view of an alternative embodiment of the shell shown in FIG. 1.

The shell 24 is constructed from multiple corrugated or fiberboard layers adhered or laminated together. Multiple laminated layers create a thick board that has greater resistance to deformation from pressure exerted by a filled internal liner than separate unlaminated layers. Referring to FIG. 14 one flute configuration of the shell 24 is three plies of fully laminated doublewall fiberboard. The outer ply 81 is constructed of an 'L' flute 83 and an 'E' flute 85, with the 'E' flute 85 to the outside of the container 20. The middle ply 87 and inner ply 89 are constructed of 'C' flutes 91 and 93, and 'L' flutes 95 and 97, respectively. The 'C' flutes 91 and 93 are toward the inside of the container 20. The 'L' flute is also known as a 'K' flute, and is 0.271 inches thick with 24.7 flutes per foot. The 'E' flute is 0.062 inches thick with 86–94 flutes per foot, and the 'C' flute is 0.142 inches thick with 36–42 flutes per foot. Referring to FIG. 19 an alternative flute configuration is three plies of fully laminated doublewall fiberboard of 'B' and 'L' flutes. The outer ply 181 is constructed of an 'L' flute 183 and a 'B' flute 185, with the 'B' flute 185 to the outside of the container 20. The middle ply 187 and inner ply 189 are constructed of 'B' flutes 191 and 193, and 'L' flutes 195 and 197, respectively. The 'L' flutes 191 and 193 are toward the inside of the container 20. The 'B' flute is 0.097 inches thick with 47–53 flutes per foot. To form the fold lines 32*a*–32*h* in the shell 24, it has been determined by the present inventors that a male score bar having a radius generally equal to that of the thickness of the paperboard material is preferred. This radius results in a score, that when folded does not tear the outer layer of paper at the fold lines and likewise does not excessively bunch up the inner layer of paper at the fold lines. The score bar should include a central rib thereon to control the initial break or fold line on the shell 24 while scoring. To help minimize any tearing and bunching when folding the shell 24, a slightly concave female score bar should be positioned on the opposing side of the shell 24 from the male score bar.

Figure 4:
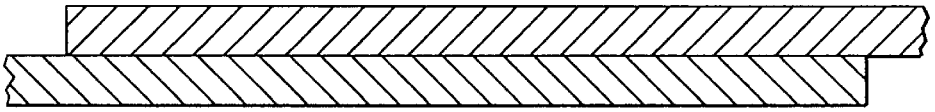
FIG. 4 is a sectional view of an alternative embodiment of the overlapping joint shown in FIG. 1.

Traditional wisdom suggests that multiple layers of paperboard material laminated together results in a joint having an excessive thickness, as shown in FIG. 4, making it difficult to construct a suitable cap to fit thereon. In order to reduce the overall thickness of the overlapping joint a multiple layered joint is used. The preferred joint, shown in FIGS. 1 and 7, use three overlapping levels adhered together. The right end portion 34 defines three increasingly thinner levels, 56*a*, 56*b* and 56*c*, and three upright ends 58*a*, 58*b*, and 58*c*. Likewise, the left end portion 36 defines three increasingly thinner levels 60*a*, 60*b* and 60*c*, and three upright ends 62*a*, 62*b*, and 62*c*. When joined together, level 56*a* is in face-to-face abutment with level 60*c*, level 56*b* is in face-to-face abutment with level 60*b*, and level 56*c* is in face-to-face abutment with level 60*a*. The number of different levels provided by each end preferably corresponds to the number of layers of paperboard laminated together. Any suitable number of layers may be used.

Figure 5:
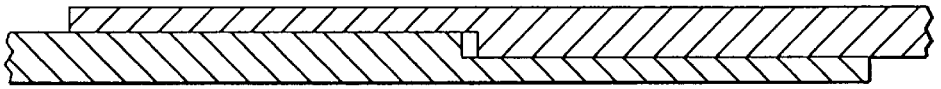
FIG. 5 is a sectional view of another alternative embodiment of the overlapping joint shown in FIG. 1.
Figure 6:
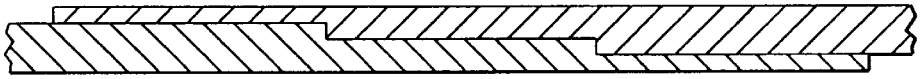
FIG. 6 is a sectional view of a further alternative embodiment of the overlapping joint shown in FIG. 1.
Figure 7:
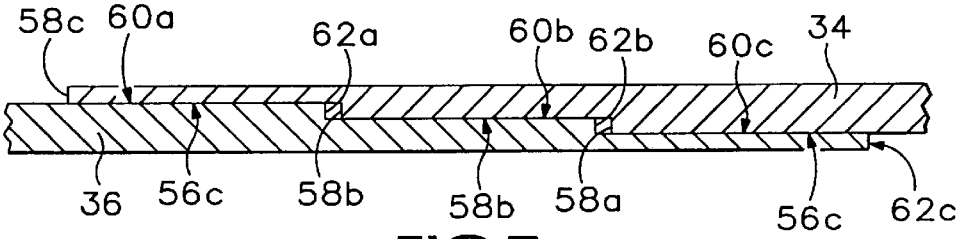
FIG. 7 is a sectional view of the preferred embodiment of the overlapping joint, as shown in FIG. 1.

The precise location where the paperboard of the shell 24 actually folds is not predictable, so it is difficult to design the overlapping portions with no gaps between abutting end portions, as shown in FIG. 6. Variations in the actual length of each level results in a pair of respective ends abutting each other, and the other pair of respective ends leaving a gap. Also, the uncertainty in the actual length of each of the individual levels results in a sidewall with a width, that may be substantially different than the width of remaining sidewalls causing the top and bottom caps to not fit properly. The present invention overcomes this limitation by selecting the length of the levels 60*b*, 60*c*, 56*b*, and 56*c* so that a gap will normally exist between abutting ends, as shown in FIGS. 5 and 7. After folding the shell 24, the overlapping joint is adjusted by decreasing or increasing the width of the gaps so that the width of the sidewall with the joint matches the remaining sidewalls. The joint may further be staggered so that the sidewall is flush along the joint.

Figure 8A:
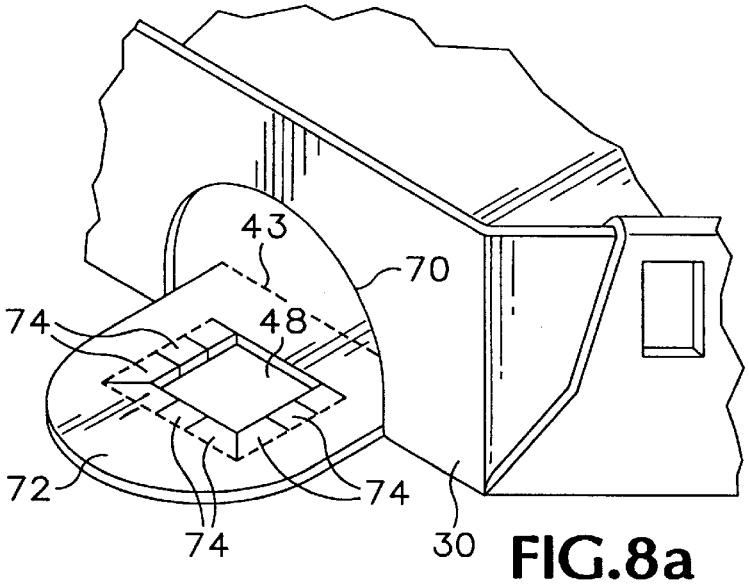
FIG. 8*a* is a breakaway view of the bottom cap shown in FIG. 1 detailing the integral locking member only partially detached.
Figure 8B:
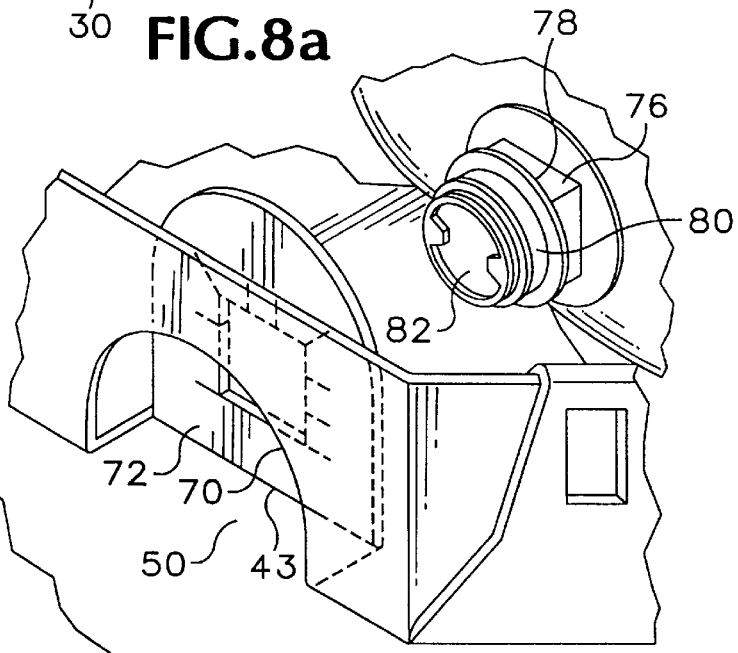
FIG. 8*b* is a breakaway view of the bottom cap detailing the integral locking member positioned upright, as shown in FIG. 1, and the fitment with the attached liner to be inserted therethrough.
Figure 9:
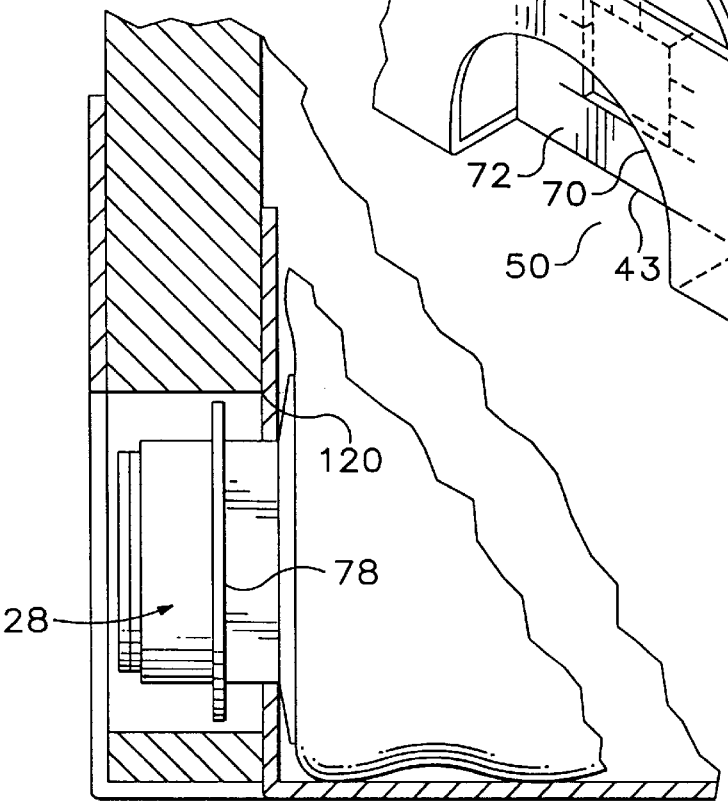
FIG. 9 is a sectional view of the shell and bottom cap detailing the interconnection of the locking member, sidewall, and fitment shown in FIG. 1.

Referring to FIG. 8*a*, the bottom cap 30 includes a retaining assembly 52 for the fitment 28. The fold line 43 is offset inwardly from the fold line 42*n* and an arch-shaped cut 70 extends from this offset so that a locking member 72 may be separated along the cut 70 and folded along the fold line 43. The locking member 72 is folded inwardly into an 'L' shape, as shown in FIG. 8*b*. The arch 70 defines the first opening 50 which is sized to allow the fitment 28 or value attached thereto to extend through. The locking member 72 is offset inwardly from the portion of the cap it is detached from by the width of the shell 24, and the shell 24 is interdisposed between the locking member 72 and arch 70, as shown in FIG. 9. The locking member 72 includes an second opening 48 with an outwardly extending starburst pattern of slits 74. The second opening 48 is rectangular and sized to tightly engage the rectangular cross-sectional locking portion 76 of the fitment 28. The ring 78 of the fitment 28 is inserted past the slits 74 and the locking portion 76 engages the rectangular second opening 48 in order to prevent rotational movement of the fitment 28, as shown in FIG. 9.

Figure 10:
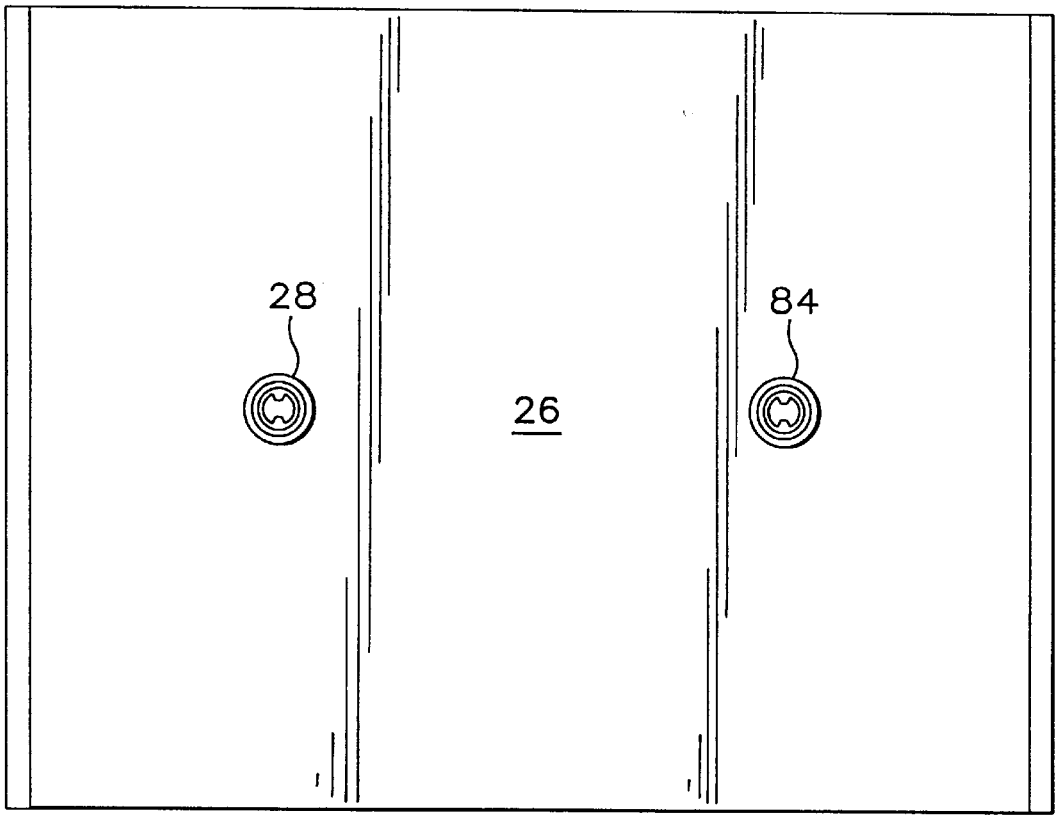
FIG. 10 is a pictorial view of the liner with two attached fitments.
Figure 11:
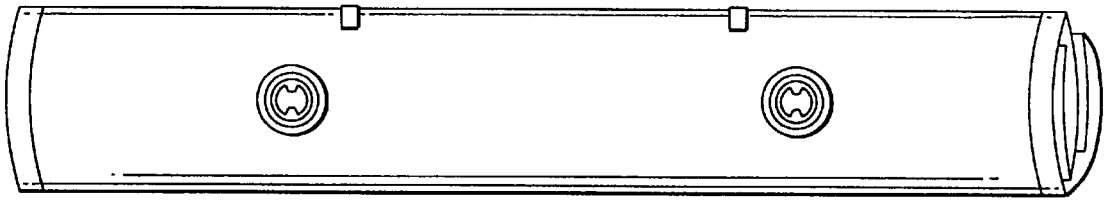
FIG. 11 is a pictorial view of the preferred folding of the liner shown in FIG. 10 secured with two pieces of tape.
Figure 12:
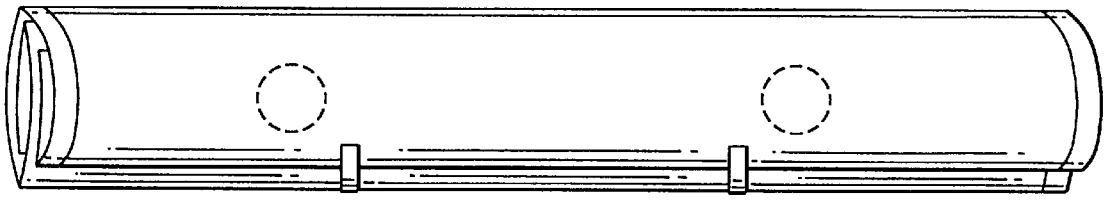
FIG. 12 is a pictorial view of the reverse side of the folded liner shown in FIG. 11.
Figure 13:
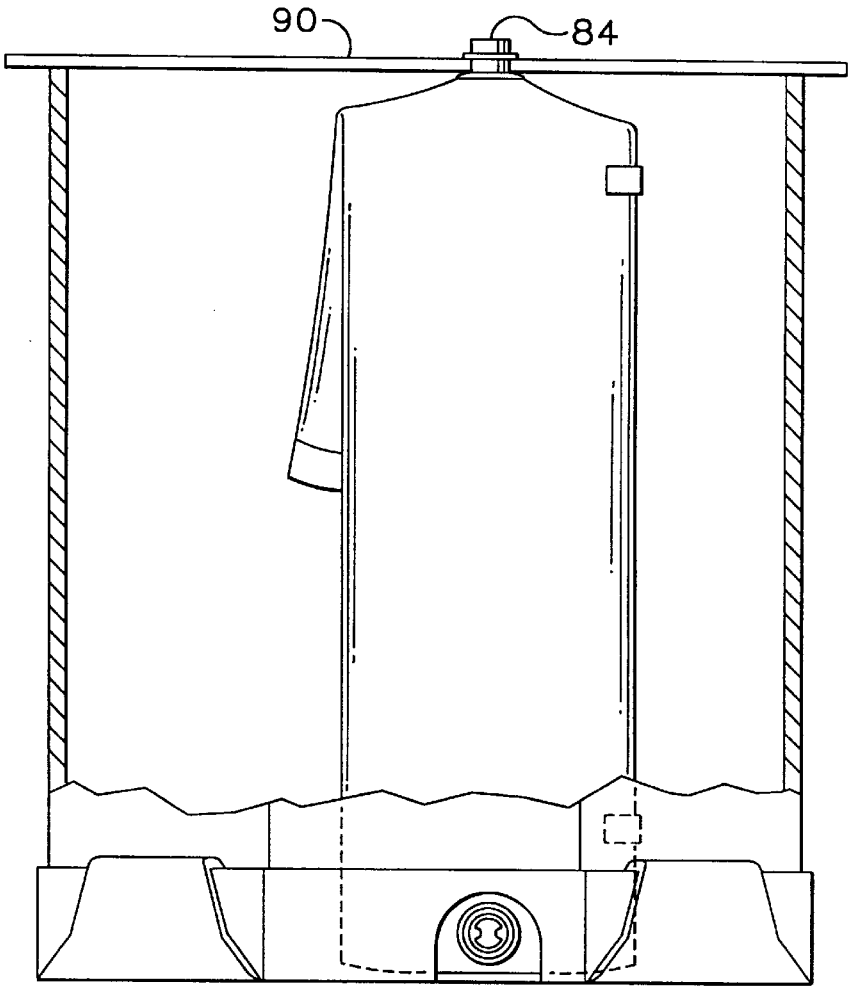
FIG. 13 is a sectional view of the folded liner of FIGS. 11 and 12 supported within the assembled container of FIG. 1, prior to filling.

Referring to FIG. 10, the liner 26 is preferably rectangular and sealed on all sides. A pair of fitments 28 and 84 are attached to the liner 26 and spaced apart approximately the distance from the outer opening 38 to the top of the container 20. The liner 26 is folded in a slightly irregular pattern, as shown in FIGS. 11 and 12, and secured with two pieces of tape 86*a* and 86*b*. Referring to FIG. 13, the liner 26 is supported within the container by a top assembly 90 which holds the top fitment 84 in position for ease of filling. The folded liner 26 is aligned offset in the assembled container 20 toward the outer 38 opening. As the liner 26 is filled, it will unfold in a manner that tends to evenly space it within the container 20, due to the particular folding pattern used, so that the liner 26 does not have to be repositioned within the container 20 in order to fill in the corners.

The assembled container has an octagonal shape. Alternatively, other polygonal or modified polygonal shapes may be used. The various elements of the container can be shipped to the user so that the container can be assembled where it is to be filled. The container 20 by virtue of its construction from inexpensive paperboard, may be utilized only once and then discarded, if desired. Alternatively, the container 20 may be utilized multiple times, for a variety of uses in addition to storage, transport and dispensing of liquids. For example, it may be used as a trash container, or collapsed and returned to the source of shipment.

As shown in FIG. 9, the ring 78 of the fitment 28 is loosely retained within the outer opening 38. When the liner 26 is filled with fluids there is a tendency for the fitment 28 to angle downwardly within the outer opening 38 because of fluid pressure within the liner 26. If this occurs, it may be difficult to thread the value into the fitment 28. Further, the outer periphery of the ring 78 has a tendency to catch on the interior edge 120 of the outer opening 38 if it is not properly aligned within the outer opening 38. This results in severe angling of the fitment 28 with respect to the outer opening 38, making it exceedingly difficult to thread the value into the fitment 28.

One way to assure proper alignment of the fitment 28 within the outer opening 38 is to select a fitment 28 with a ring 78 that has a diameter greater than the diameter of the outer opening 38 so that the ring 78 abuts the outer opening 38 in a flush manner. However, such fitments are not readily available. An alternative approach is to decrease the diameter of the outer opening 38 so that the ring 78 abuts the outer opening 38 in a flush manner. However, valves sized to fit within an outer opening 38 with a decreased diameter may not be readily available.

Figure 15:
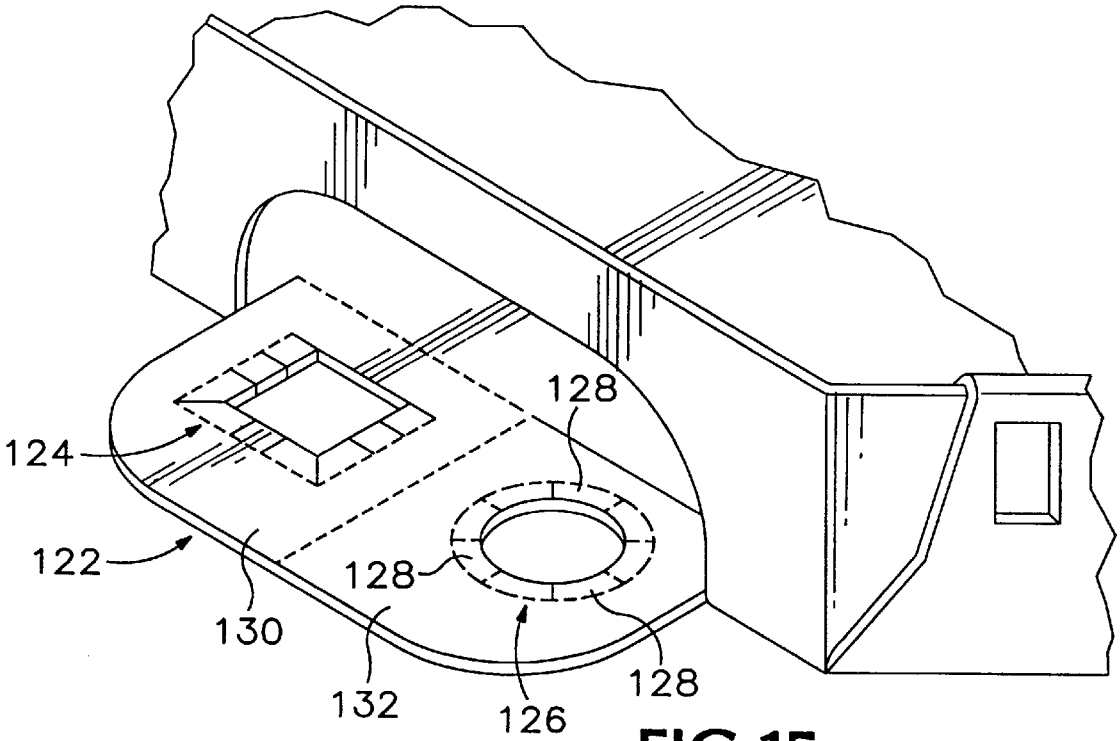
FIG. 15 is a breakaway view of an alternative embodiment of the bottom cap detailing an integral locking member only partially detached.
Figure 16:
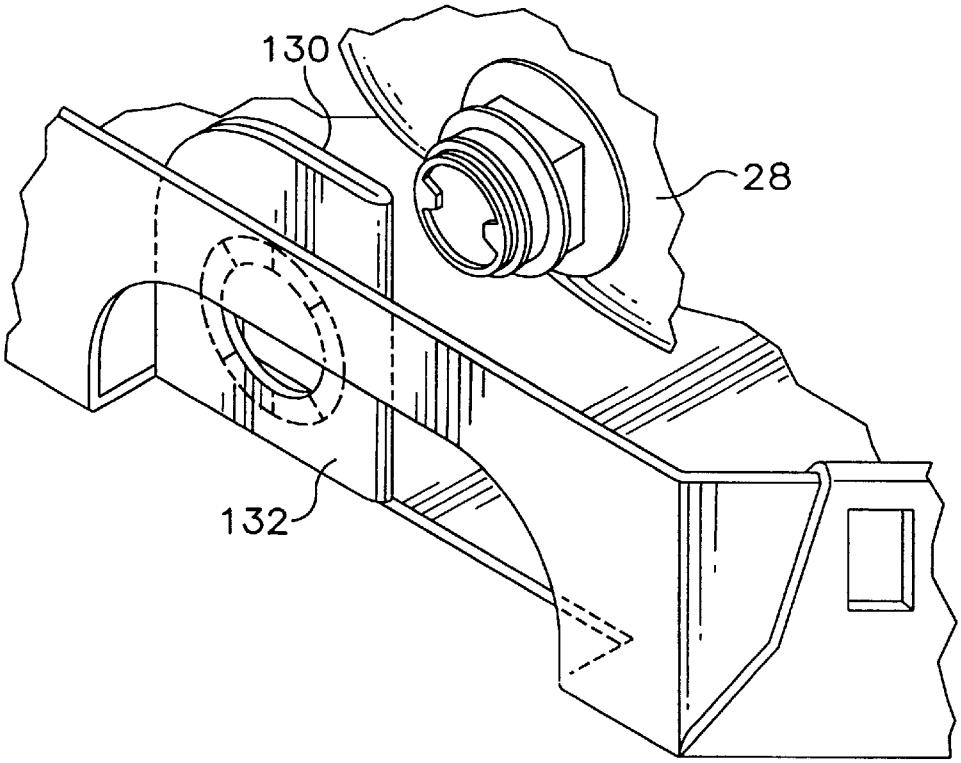
FIG. 16 is a breakaway view of the alternative embodiment of the bottom cap show in FIG. 15 detailing the integral locking member positioned upright, and the fitment with the attached liner to be inserted therethrough.
Figure 17:
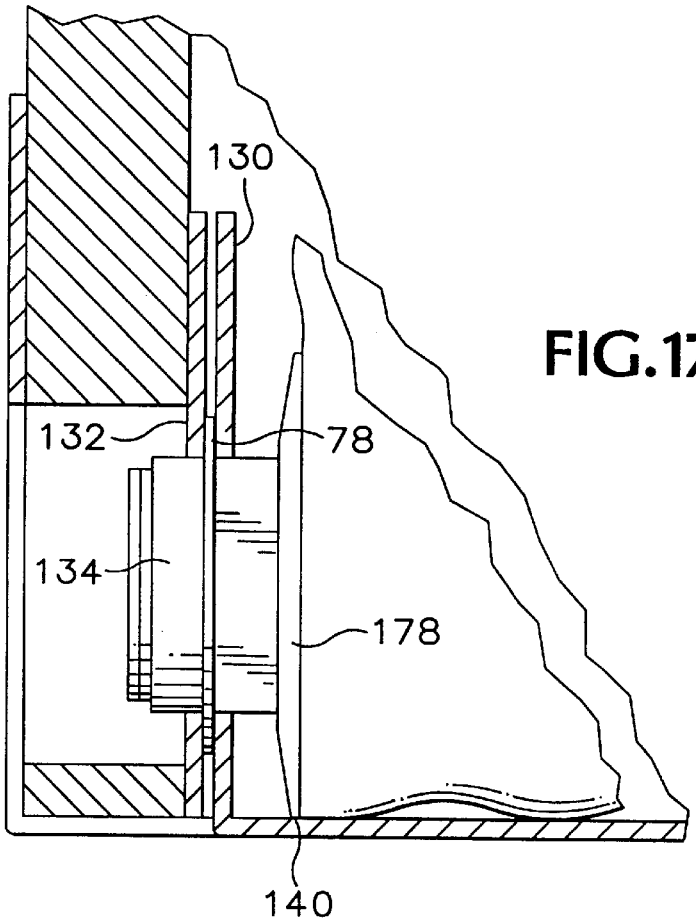
FIG. 17 is a sectional view of the shell shown in FIG. 1 and bottom cap shown in FIG. 16, detailing the interconnection of the locking member, sidewall, and fitment.

Referring to FIG. 15, a locking member 122 provides additional structural support to maintain proper alignment of the fitment 28 without modification of the fitment 28 or outer opening 38. The locking member 122 defines a square starburst opening 124 on a left portion 130, similar to the retaining assembly 52 (FIG. 3). The locking member 122 also defines a circular opening 126 with a plurality of slits 128 on a right portion 132. Referring to FIG. 16, the locking member 122 is assembled in a manner similar to the retaining assembly 52 (FIG. 8*b*) with the right portion 132 folded over (overlaying) the left portion 130. Referring to FIG. 17, the ring 78 is interdisposed between and supported by the right portion 132 and the left portion 130. The circular opening 126 engages the circular portion 134 of the fitment 28 to help maintain its alignment with respect to the outer opening 38. The use of both the starburst opening 124 and the circular opening 134, with the ring 78 interdisposed therebetween, provides accurate alignment of the fitment 28 and additional resistance to misalignment from pressure exerted by fluids in the liner 26. In addition, the bottom edge of the inner flange 178 abuts the bottom 140 of the container to provide additional structural support against the fitment 28 tipping downwardly. Also with the inner flange 178 abutting the bottom 140 of the container it provides a reference point to more accurately align the fitment 28 with the outer opening 38.

Figure 18:
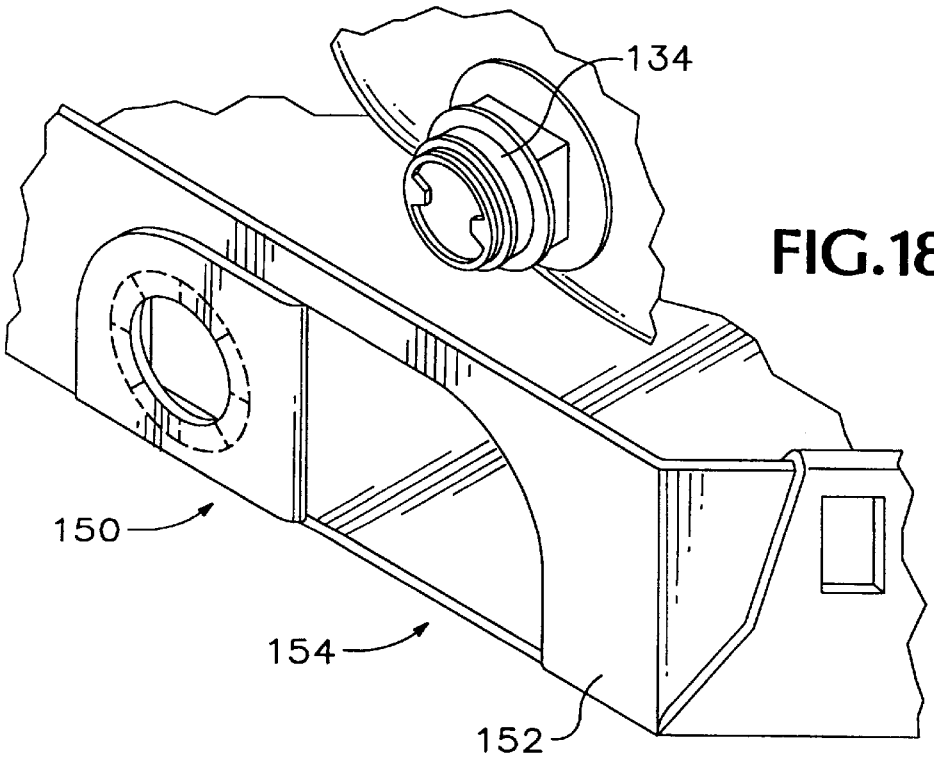
FIG. 18 is a breakaway view of a further alternative embodiment of the bottom cap detailing an integral locking member, and the fitment with the attached liner to be inserted therethrough.

Referring to FIG. 18, a locking member 150, similar to that shown in FIGS. 15–17, is generally flush with the exterior wall 152 of the bottom cap 154 when assembled. The bottom cap 154 is configured in what is generally known as a cassette configuration. The bottom cap 154 is slightly smaller in diameter than the interior of the shell 24, so that the combination of the fitment 28 and liner 26 may be attached thereto and inserted within the shell 24. Assembly of the container as shown in FIGS. 1–17 requires the following steps: (1) shape the tube upside down; (2) lock the liner and fitment into the bottom cap; (3) place the liner, fitment, and cap over the inverted tube; (4) center the fitment in the outer opening; (5) invert the assembly onto a pallet; and (6) fill the liner. In contrast, assembly of the container with a cassette configuration requires the following steps: (1) shape the tube right side up; (2) lock the liner and fitment into the cassette; (3) lower the cassette, liner, and fitment the full length of the tube; (4) align the fitment with the outer opening; and (5) fill the liner. The use of the cassette configuration eliminates one step of assembly, which may decrease the time required for assembly.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A container for fluid materials comprising:

(a) an upright tubular shell having a top end and a bottom end, said shell including a plurality of side-by-side sidewalls;

(b) a flexible, impervious liner located within said shell;

(c) a fitment attached to said liner for emptying said liner of fluid materials;

(d) an outer opening defined in one of said sidewalls proximate said bottom end for receiving a portion of said fitment, said outer opening being in the plane of a major portion of said one of said sidewalls, said outer opening being integral with said major portion of said one of said sidewalls; and (e) an integral bottom cap defining a first opening and a second opening, said outer opening being interdisposed between and aligned with said first opening and said second opening.

2. The container of claim 1 wherein said fitment defines a locking portion and said second opening is adapted to engage said locking portion so as to prevent rotational movement of said fitment.

3. The container of claim 2 wherein said locking portion has a rectangular cross-section and said second opening has a rectangular cross-section.

4. The container of claim 2 further comprising a plurality of slits extending radially outward from said locking portion.

5. The container of claim 1 wherein said first opening is defined in a portion of the bottom cap that is bent inwardly with an "L" shape.

6. The container of claim 1 wherein said first opening is arch shaped.

7. The container of claim 1 wherein said outer opening is offset toward one of a pair of sides of said one of said sidewalls.

8. The container of claim 1 further comprising:

(a) said shell constructed of a plurality of layers of paperboard material;

(b) a first one of said plurality of side-by-side sidewalls defining a first portion adjacent a first upright edge of said first sidewall having a thickness less than the thickness of the adjacent portion of said first sidewall;

(c) said first portion comprising less than all of said plurality of layers of said paperboard material; and (d) said first portion overlapping and attached to a second one of said plurality of side-by-side sidewalls.

9. The container of claim 8 wherein said outer opening is offset toward one of a pair of sides of said one of said sidewalls.

10. A container for fluid materials comprising:

(a) an upright tubular shell having a top end and a bottom end, said shell including a plurality of side-by-side sidewalls each of which has a pair of sides;

(b) means for closing said bottom end of said shell;

(c) a flexible, impervious liner located within said shell;

(d) a fitment attached to said liner for emptying said liner of fluid materials;

(e) an outer opening defined in one of said sidewalls proximate said bottom end and offset toward a respective one of said pair of sides of said one of said sidewalls for receiving a portion of said fitment, said outer opening being in the plane of a major portion of said one of said sidewalls, said outer opening being integral with said major portion of said one of said sidewalls; and (f) said means for closing said bottom end of said shell is an integral bottom cap defining a first opening and a second opening, said outer opening being interdisposed between and aligned with said first opening and said second opening.

11. The container of claim 10 wherein said fitment defines a locking portion and said second opening is adapted to engage said locking portion so as to prevent rotational movement of said fitment.

12. The container of claim 11 wherein said locking portion has a rectangular cross-section and said second opening has a rectangular cross-section.

13. The container of claim 11 further comprising a plurality of slits extending radially outward from said locking portion.

14. The container of claim 10 wherein said first opening is defined in a portion of the bottom cap that is bent inwardly with an "L" shape.

15. The container of claim 10 further comprising:

(a) said shell constructed of a plurality of layers of paperboard material;

(b) a first one of said plurality of side-by-side sidewalls defining a first portion adjacent a first upright edge of said first sidewall having a thickness less than the thickness of the adjacent portion of said first sidewall;

(c) said first portion comprising less than all of said plurality of layers of said paperboard material; and (d) said first portion overlapping and attached to a second one of said plurality of side-by-side sidewalls.

16. A container for fluid materials comprising:

(a) an upright tubular shell having a top end and a bottom end, said shell including a plurality of side-by-side sidewalls;

(b) means for closing said bottom end of said shell;

(c) a flexible, impervious liner located within said shell;

(d) a fitment attached to said liner for emptying said liner of fluid materials;

(e) an outer opening defined in one of said sidewalls proximate said bottom end suitable to receive a portion of said fitment;

(f) said shell constructed of a plurality of layers of paperboard material;

(g) a first one of said plurality of side-by-side sidewalls defining a first portion adjacent a first upright edge of said first sidewall having a thickness less than the thickness of the adjacent portion of said first sidewall, said first one of said plurality of side-by-side sidewalls defining a second portion adjacent said first portion having a thickness greater than the thickness of said first portion, a first upright edge interconnecting said first portion and said second portion;

(h) said first portion comprising less than all of said plurality of layers of said paperboard material;

(i) a second one of said plurality of side-by-side sidewalls defining a third portion adjacent a first upright edge of said second sidewall having a thickness less than the thickness of the adjacent portion of said second sidewall, said second one of said plurality of side-by-side sidewalls defining a fourth portion adjacent said third portion having a thickness greater than the thickness of said third portion, a second upright edge interconnecting said third portion and said fourth portion; and (j) said first sidewall overlapping and attached to said second sidewall such that said first portion is in face-to-face abutment with said fourth portion, said third portion is in face-to-face abutment with said second portion, and said first upright edge is spaced apart from said second upright edge leaving a gap therebetween, where the combined width of said first sidewall overlapping said second sidewall matches at least one of the remaining said sidewalls.

17. The container of claim 16 wherein said means for closing said bottom end of said shell is a bottom cap defining a first opening and a second opening, said outer opening being interdisposed between and aligned with said first opening and said second opening.

18. The container of claim 17 wherein said fitment defines a locking portion and said second opening is adapted to engage said locking portion so as to prevent rotational movement of said fitment.

19. The container of claim 18 wherein said locking portion has a rectangular cross-section and said second opening has a rectangular cross-section.

20. The container of claim 18 further comprising a plurality of slits extending radially outward from said locking portion.

21. The container of claim 17 wherein said inner opening is defined in a portion of the bottom cap that is bent inwardly in an "L" shape.

22. The container of claim 16 wherein said outer opening is offset toward one of a pair of sides of said one of said sidewalls.

23. The container of claim 16 further comprising:

(a) said first one of said plurality of side-by-side sidewalls defining a second portion adjacent a second upright edge of said first sidewall having a thickness less than the thickness of said first portion;

(b) said second portion comprising a fewer number of said layers than the number of said layers of said first portion; and (c) said second portion overlapping and attached to said second one of said plurality of side-by-side sidewalls.

24. A container for fluid materials comprising:

(a) an upright tubular shell having a top end and a bottom end, said shell including a plurality of side-by-side sidewalls;

(b) means for closing said bottom end of said shell;

(c) a flexible, impervious liner located within said shell;

(d) a fitment attached to said liner for emptying said liner of fluid materials;

(e) an outer opening defined in one of said sidewalls proximate said bottom end suitable to receive a portion of said fitment;

(f) said shell constructed of three plies of fully laminated doublewall fiberboard;

(g) a first one of said three plies including an "L" flute and an "E" flute, with said "E" flute toward the outside of said shell;

(h) a second one of said three plies including a "C" flute and an "L" flute, with the "C" flute toward the inside of said shell; and (i) a third one of said three plies including a "C" flute and an "L" flute, with the "C" flute toward the inside of said shell.

25. A container for fluid materials comprising:

(a) an upright tubular shell having a top end and a bottom end, said shell including a plurality of side-by-side sidewalls;

(b) means for closing said bottom end of said shell;

(c) a flexible, impervious liner located within said shell;

(d) a fitment attached to said liner for emptying said liner of fluid materials;

(e) an outer opening defined in one of said sidewalls proximate said bottom end suitable to receive a portion of said fitment;

(f) said shell constructed of three plies of fully laminated doublewall fiberboard;

(g) a first one of said three plies including an "L" flute and an "B" flute, with said "B" flute toward the outside of said shell;

(h) a second one of said three plies including a "B" flute and an "L" flute, with the "B" flute toward the inside of said shell; and (i) a third one of said three plies including a "B" flute and an "L" flute, with the "B" flute toward the inside of said shell.

26. A container for fluid materials comprising:

(a) an upright tubular shell having a top end and a bottom end, said shell including a plurality of side-by-side sidewalls;

(b) a flexible, impervious liner located within said shell;

(c) a fitment attached to said liner for emptying said liner of fluid materials;

(d) an outer opening defined in one of said sidewalls proximate said bottom end for receiving a portion of said fitment, said outer opening being in the plane of a major portion of said one of said sidewalls, said outer opening being integral with said major portion of said one of said sidewalls; and (e) an integral bottom cap defining a first opening and a second opening, said first opening overlaying said second opening, and both said first and second openings aligned with said outer opening.

27. The container of claim 26 wherein said bottom cap defines a third opening, said outer opening being interdisposed between and aligned with said third opening and said first opening.

28. The container of claim 26 wherein said fitment defines a locking portion and said second opening is adapted to engage said locking portion so as to prevent rotational movement of said fitment.

29. The container of claim 28 wherein said locking portion has a rectangular cross-section and said second opening has a rectangular cross-section.

30. The container of claim 29 wherein said fitment defines a tubular portion with a circular cross-section and said first opening is adapted to engage said tubular portion.

31. The container of claim 26 wherein said bottom cap has a diameter less than the diameter of said shell so that it may be located within said shell.

32. A container for fluid materials comprising:

(a) an upright tubular shell having a top end and a bottom end, said shell including a plurality of side-by-side sidewalls;

(b) a flexible, impervious liner located within said shell;

(c) a fitment attached to said liner for emptying said liner of fluid materials;

(d) an outer opening defined in one of said sidewalls proximate said bottom end for receiving a portion of said fitment;

(e) a bottom cap defining a first opening and a second opening, said outer opening being interdisposed between and aligned with said first opening and said second opening;

(f) said fitment defines a locking portion and said second opening is adapted to engage said locking portion so as to prevent rotational movement of said fitment; and (g) a plurality of slits extending radially outward from said locking portion.

33. A container for fluid materials comprising:

(a) an upright tubular shell having a top end and a bottom end, said shell including a plurality of side-by-side sidewalls each of which has a pair of sides;

(b) means for closing said bottom end of said shell;

(c) a flexible, impervious liner located within said shell;

(d) a fitment attached to said liner for emptying said liner of fluid materials;

(e) an outer opening defined in one of said sidewalls proximate said bottom end and offset toward a respective one of said pair of sides of said one of said sidewalls for receiving a portion of said fitment;

(f) said means for closing said bottom end of said shell is a bottom cap defining a first opening and a second opening, said outer opening being interdisposed between and aligned with said first opening and said second opening;

(g) said fitment defines a locking portion and said second opening is adapted to engage said locking portion so as to prevent rotational movement of said fitment; and (h) a plurality of slits extending radially outward from said locking portion.

34. A container for fluid materials comprising:

(a) an upright tubular shell having a top end and a bottom end, said shell including a plurality of side-by-side sidewalls;

(b) means for closing said bottom end of said shell;

(c) a flexible, impervious liner located within said shell;

(d) a fitment attached to said liner for emptying said liner of fluid materials;

(e) an outer opening defined in one of said sidewalls proximate said bottom end suitable to receive a portion of said fitment;

(f) said shell constructed of a plurality of layers of paperboard material;

(g) a first one of said plurality of side-by-side sidewalls defining a first portion adjacent a first upright edge of said first sidewall having a thickness less than the thickness of the adjacent portion of said first sidewall;

(h) said first portion comprising less than all of said plurality of layers of said paperboard material;

(i) said first portion overlapping and attached to a second one of said plurality of side-by-side sidewalls;

(j) said means for closing said bottom end of said shell is a bottom cap defining a first opening and a second opening, said outer opening being interdisposed between and aligned with said first opening and said second opening;

(k) said fitment defines a locking portion and said second opening is adapted to engage said locking portion so as to prevent rotational movement of said fitment; and (l) a plurality of slits extending radially outward from said locking portion.

35. A container for fluid materials comprising:

(a) an upright tubular shell having a top end and a bottom end, said shell including a plurality of side-by-side sidewalls;

(b) a flexible, impervious liner located within said shell;

(c) a fitment attached to said liner for emptying said liner of fluid materials;

(d) an outer opening defined in one of said sidewalls proximate said bottom end for receiving a portion of said fitment;

(e) a bottom cap defining a first opening and a second opening, said first opening overlaying said second opening, and both said first and second openings aligned with said outer opening; and (f) said bottom cap defines a third opening, said outer opening being interdisposed between and aligned with said third opening and said first opening.

36. A container for fluid materials comprising:

(a) an upright tubular shell having a top end and a bottom end, said shell including a plurality of side-by-side sidewalls;

(b) a flexible, impervious liner located within said shell;

(c) a fitment attached to said liner for emptying said liner of fluid materials;

(d) an outer opening defined in one of said sidewalls proximate said bottom end for receiving a portion of said fitment;

(e) a bottom cap defining a first opening and a second opening, said first opening overlaying said second opening, and both said first and second openings aligned with said outer opening; and (f) said bottom cap has a diameter less than the diameter of said shell so that it may be located within said shell.

37. A container for fluid materials comprising:

(a) an upright tubular shell having a top end and a bottom end, said shell including a plurality of side-by-side sidewalls;

(b) means for closing said bottom end of said shell;

(c) a flexible, impervious liner located within said shell;

(d) a fitment attached to said liner for emptying said liner of fluid materials;

(e) an outer opening defined in one of said sidewalls proximate said bottom end suitable to receive a portion of said fitment;

(f) said shell constructed of a plurality of layers of paperboard material;

(g) a first one of said plurality of side-by-side sidewalls defining a first portion adjacent a first upright edge of said first sidewall having a thickness less than the thickness of the adjacent portion of said first sidewall, said first one of said plurality of side-by-side sidewalls defining a second portion adjacent said first portion having a thickness greater than the thickness of said first portion, said first one of said plurality of side-by-side sidewalls defining a fifth portion adjacent said second portion having a thickness greater than the thickness of said second portion, a first upright edge interconnecting said first portion and said second portion, a third upright edge interconnecting said second portion and said fifth portion;

(h) said first portion comprising less than all of said plurality of layers of said paperboard material, said second portion comprising less than all of said plurality of said paperboard material;

(i) a second one of said plurality of side-by-side sidewalls defining a third portion adjacent a first upright edge of said second sidewall having a thickness less than the thickness of the adjacent portion of said second sidewall, said second one of said plurality of side-by-side sidewalls defining a fourth portion adjacent said third portion having a thickness greater than the thickness of said third portion, said second one of said plurality of side-by-side sidewalls defining a sixth portion adjacent said fourth portion having a thickness greater than the thicknesses of said fourth portion, a second upright edge interconnecting said third portion and said fourth portion, a fourth upright edge interconnecting said fourth portion and said sixth portion; and (j) said first sidewall overlapping and attached to said second sidewall such that said first portion is in face-to-face abutment with said sixth portion, said second portion is in face-to-face abutment with said fourth portion, said fifth portion is in face-to-face abutment with said third portion, at least one of a first pair of said first upright edge is spaced apart from said fourth upright edge and a second pair of said second upright edge is spaced apart from said third upright edge leaving at least a gap therebetween at least one of said first pair and said second pair, where the combined width of said first sidewall overlapping said second sidewall matches at least one of the remaining said sidewalls.

38. A container for fluid materials comprising:

(a) an upright tubular shell having a top end and a bottom end, said shell including a plurality of side-by-side sidewalls;

(b) means for closing said bottom end of said shell;

(c) a flexible, impervious liner located within said shell;

(d) a fitment attached to said liner for emptying said liner of fluid materials;

(e) an outer opening defined in one of said sidewalls proximate said bottom end suitable to receive a portion of said fitment;

(f) said shell constructed of a plurality of layers of paperboard material;

(g) a first one of said plurality of side-by-side sidewalls defining at least a first portion and a second portion having different thicknesses where said first portion is adjacent a first upright edge of said first sidewall, a first upright edge interconnecting two portions of said first sidewall having different thicknesses;

(h) said first portion comprising less than all of said plurality of layers of said paperboard material;

(i) a second one of said plurality of side-by-side sidewalls defining at least a third portion and a fourth portion having different thicknesses where said third portion is adjacent a first upright edge of said second sidewall, a second upright edge interconnecting two portions of said second sidewall having different thicknesses;

(j) said third portion comprising less than all of said plurality of layers of said paperboard material; and (k) said first sidewall overlapping and attached to said second sidewall such that said first upright edge is spaced apart from and aligned with said second upright edge leaving a gap therebetween where the combined width of said first sidewall overlapping said second sidewall matches at least one of the remaining said sidewalls.

* * * * *